United States Patent [19]

Datta

[11] 4,130,164

[45] Dec. 19, 1978

[54] PROCESS FOR COAL GASIFICATION

[75] Inventor: Rabinder S. Datta, Syracuse, N.Y.

[73] Assignee: Syracuse Research Corporation, Syracuse, N.Y.

[21] Appl. No.: 823,803

[22] Filed: Aug. 11, 1977

[51] Int. Cl.[2] ..... E21B 43/24; E21B 43/27; E21C 41/02; E21C 41/04

[52] U.S. Cl. ..... 166/259; 166/261; 166/266; 299/5

[58] Field of Search ..... 166/259, 261, 271, 265, 166/266, 267, 307; 241/1; 299/3-5, 7

[56] References Cited

U.S. PATENT DOCUMENTS

| | | | |
|---|---|---|---|
| 2,584,605 | 2/1952 | Merriam et al. | 166/258 X |
| 2,788,956 | 4/1957 | Pevere et al. | 166/259 |
| 3,734,184 | 5/1973 | Scott | 166/259 |
| 3,815,826 | 6/1974 | Aldrich et al. | 241/1 |
| 3,850,477 | 11/1974 | Aldrich et al. | 299/5 |
| 3,918,761 | 11/1975 | Aldrich | 299/5 |
| 4,018,481 | 4/1977 | Terry | 166/261 X |
| 4,032,193 | 6/1977 | Drinkard et al. | 299/4 |
| 4,059,151 | 11/1977 | Terry | 166/258 |

*Primary Examiner*—Stephen J. Novosad
*Attorney, Agent, or Firm*—Blum, Moscovitz, Friedman & Kaplan

[57] ABSTRACT

The efficiency of conversion of coal in the coal-gasification process is increased by pre-treatment of the coal to increase the fluid-permeability thereof. The reagent used for increasing the coal permeability is recoverable in high yield. Pre-treatment of bituminous coal by this process makes it possible to gasify coals of this rank effectively, such coals previously having been gasifiable only at low conversion efficiencies. Pre-treatment with a permeability-enhancing reagent is also useful as a step in the process of dissolving coal.

21 Claims, 11 Drawing Figures

PROCESS FOR COAL GASIFICATION

BACKGROUND OF THE INVENTION

The problem of more effective utilization of coal is now being attacked on an emergency basis as the result of the approaching end to the availability of oil. A number of plans have been devised for circumventing the expense and danger of mining. Open-pit mining and strip mining have only limited application since tremendous quantities of coal are positioned deep in the earth. To obtain the energy locked into coal in coal seams, the ancient process of deep-pit mining has been the only available means.

Recently, processes for chemical comminution of coal, both above ground and below ground have been disclosed in U.S. Pat. Nos. 3,815,826, 3,850,477, 3,870,237 and 3,918,761. According to the processes taught in these patents the interlayer forces at natural interfaces present in the coal is weakened by contact with a number of reagents such as gaseous anhydrous ammonia, liquid anhydrous ammonia, aqueous ammonia, organic solvents with molecular weights lower than 100, and alkali. As a result of such weakening of interlayer forces the coal fractures either spontaneously or with the expenditure of substantially less energy than is usually necessary.

These patents teach the treatment of coal in underground coal seams for the purpose of removing the coal from such seams to the surface. Once the coal is brought to the surface, shipment of the coal to the area of use is then envisioned.

Since bringing the coal to the surface and shipment of the coal to the user are both expensive, attempts have been made to extract the energy of the coal while it is still underground. Foremost among such attempts has been the development of underground coal gasification to produce a combustible gas which can then be transported by pipeline. While considerable progress in the development of this process has been made, the conversion efficiency remains disappointing. This difficulty stems from a number of sources, outstanding among which is the low permeability of coal to the flow of gas therethrough. As is evident, combustion cannot be carried out efficiently unless an oxygen-containing gas can be passed through the coal seam. To cope with this problem, it has been the practice to introduce explosives into the coal seam through bore holes for the purpose of fracturing the coal. Pneumatic and hydraulic fracturing are also sometimes utilized. Unfortunately, it frequently happens that fracturing takes place beyond the boundaries of the coal seam so that water can leak into the seam from the over-burden and gas can be lost from the seam. Moreover, fracturing may not be evenly distributed throughout the seam leading to under-utilization of the coal during gasification. Also, it is necessary to shut down the operation when it is desired to start combustion in a new portion of the seam. This makes for frequent cessation of operation and increase in cost. Also, the area which can be effectively broken up by prior means is limited so that, in general, the maximum size of a panel of coal which can be burned in a single step after such preparation is about 100 ft. × 100 ft.

Lignite coal is the best type for use in the gasification process, but even with this type of coal, conversion efficiency is about 60% at best. As the rank of the coal ascends the conversion efficiency drops off and, finally, bituminous coal has been found to be extremely unsuitable for the gasification process as hitherto practiced, due to the fact that it swells and becomes impermeable to gas flow therethrough. Since a large portion of the available coal is bituminous, the non-reactivity of this type of coal in the coal gasification process constitutes a serious limitation on the applicability of the process.

As is evident, then, it would be highly desirable to be able to increase the efficiency of the conversion process with the most suitable coals as well as to be able to render bituminous coal and coals of higher rank suitable for use in coal gasification.

SUMMARY OF THE INVENTION

I have found that those substances which weaken the interlayer forces between layers of coal also increase the permeability of said coal to the flow of fluids therethrough, the term "fluid" including both gases and liquids. Preferred are the reagents gaseous anhydrous ammonia, liquid anhydrous ammonia, aqueous ammonia, mixtures of these materials and methanol. To increase the permeability of the coal to the flow of fluid therethrough, it is only necessary that the reagent remains in contact with the coal for a suitable period, generally from about 5 hours to about 1 week, depending mostly on the particular coal.

After treatment of the coal with the selected reagent, the reagent can be re-covered, either by sweeping the reagent out of the coal with a gas such as air or by vacuuming the coal. The reagent may be conveniently applied to any pressure up to about 65 psia or greater, and, if desired, in the presence of air.

For underground seams, a single bore hole may be used for introduction of the reagent, recovery of the reagent, introduction of an oxygen-containing gas, either air or oxygen itself, and removal of the combustible gas. In another embodiment of the invention bore holes in pairs may be used, air being introduced through one bore hole and removed through an adjacent bore hole after treatment with the reagent, recovery of the reagent and raising a portion of the coal to the combustion temperature by the use of a heater.

A significant feature of the invention is that panels measuring up to about 200 ft. × 200 ft. or higher may be treated as a single unit in accordance with the invention.

Treatment of coal to increase the permeability thereof is useful when coal is to be gasified above ground and also when the coal is to be taken into solution by a solvent such as propylamine.

Accordingly, an object of the present invention is an improved process of coal gasification including the treatment of coal to increase the permeability thereof to the flow of fluid therethrough.

Another object of the present invention is an improved coal gasification process in which gas permeability of the coal in a coal seam has been improved to the point where areas substantially larger than has hitherto been the case can be treated as a single unit in the combustion process.

A further object of the present invention is an improved coal-gasification process in which the process can be carried out on a continuous basis.

Still another object of the invention is recovery of methane from coal whether mined by conventional techniques or gasified.

An important object of the present invention is an improved coal-gasification process in which the disadvantages attendant upon the use of explosives or other techniques like pneumatic or hydraulic fracturing to fracture the coal in a coal seam can be avoided.

A significant object of the present invention is an improved coal-gasification process in which the efficiency of coal conversion is increased and which can effectively utilize coal of high rank as well as lignite and sub-bituminous.

Still other objects and advantages of the invention will in part be obvious and will in part be apparent from the specification.

The invention accordingly comprises the several steps and the relation of one or more of such steps with respect to each of the others thereof, which will be exemplified in the process hereinafter disclosed, and the scope of the invention will be indicated in the claims.

BRIEF DESCRIPTION OF THE DRAWINGS

For a fuller understanding of the invention, reference is had to the following description taken in conjunction with the accompanying drawings, in which.

DESCRIPTION OF THE PREFERRED EMBODIMENTS

In preparation for underground gasification of coal, it is general practice to introduce air or oxygen through one bore hole and remove the combustion products, in this case, a combustible gas, through a second bore hole. These steps are inadequate for the efficient production of a combustible gas because of the fact that the gas-permeability of the usual coal seam is too low to permit rapid transfer of gas from one bore hole to the next. Accordingly, it becomes necessary to increase the porosity of the coal seam, usually by the appropriate use of explosives or other method, e.g., (1) pneumatic fracturing, (2) hydraulic fracturing, (3) back burning. The explosives can be positioned through the use of side galleries or by introduction from the surface through a bore hole. However, the area which can be rendered permeable by such treatments is limited, as a result of which bore holes to be operated in conjunction must usually be within one hundred feet of each other. Thus, the largest panel of coal which can be treated in a single combustion step is about 100 ft. square.

Figure 1A:
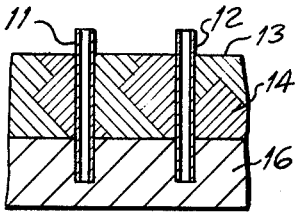
FIG.1A PRIOR ART
FIGS. 1A through 1F show steps in the conventional process of coal gasification.
Figure 1B:
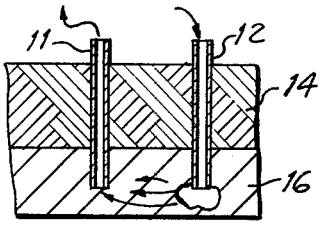
FIG.1B PRIOR ART

FIG. 1A shows schematically a pair of bore holes 11 and 12 penetrating from surface 13 of the earth through over-burden 14 into a virgin coal seam 16. Assuming that steps have been taken to provide sufficient porosity in coal seam 16, an electric heater is introduced through bore hole 12 to raise the temperature of the coal in the immediate vicinity of said bore hole to the ignition point. Conventionally, the quantity of air or oxygen supplied is such that a combustible gas is produced, the combustible gas being removed through bore hole 11 (FIG. 1B).

Figure 1C:
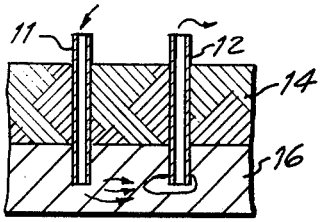
FIG.1C PRIOR ART
Figure 1D:
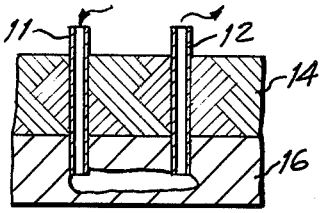
FIG.1D PRIOR ART
Figure 1E:
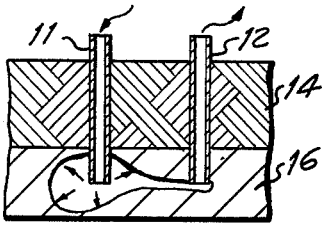
FIG.1E PRIOR ART
Figure 1F:
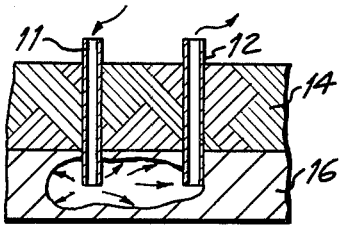
FIG.1F PRIOR ART

The direction of introduction of air may be reversed, high pressure air being injected through bore hole 11 as shown in FIG. 1C, the combustion front moving from bore hole 12 toward bore hole 11 and eventually linking with bore hole 11 as shown in FIG. 1D. At this point, air or oxygen is injected at low pressure. The volume of air injected is increased and the general combustion surface expands outwardly toward the margins of the coal seam as shown in FIGS. 1E and 1F, the combustible gas produced being removed through bore hole 12.

Figure 2A:
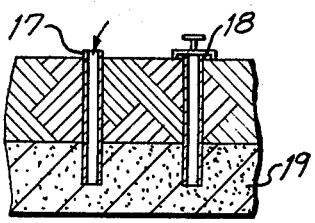
FIGS. 2A through 2C show steps in accordance with the present process.

The process of the present invention differs principally from that shown in FIGS. 1A through 1F in that chemical treatment is utilized for producing the necessary permeability rather than explosion or other method. Thus, FIG. 2A shows bore holes 17 and 18 penetrating into coal seam 19. A chemical which can increase the permeability of coal seam 19 to fluids, the term "fluids" including both liquids and gases, is introduced in an effective amount through bore hole 17 and allowed to remain in contact with said coal seam for a period long enough so that the permeability of coal seam 19 is increased over the entire region between bore holes 17 and 18.

Suitable reagents for increasing the fluid permeability of coal seam 19 are gaseous anhydrous ammonia, liquid anhydrous ammonia, aqueous ammonia, mixtures of these materials and methanol. Suitable periods of time for achieving the desired increase in permeability are between about 5 hours and one week depending mostly on the type of coal. The selected reagent may be introduced either alone or in combination with air or an inert gas such as nitrogen which provides the benefit of reducing the possibility of explosion as methane is released from the coal. Steam can also be used for the purpose, especially when the water content of the coal is below about 10%. Further, the selected reagent may be introduced at any pressure up to about 65 psia, or even higher. Also, when introduced with air or other gas, the partial pressure of the reagent may be as high as that specified and the total pressure may be as high as 180 psia or higher.

Figure 2B:
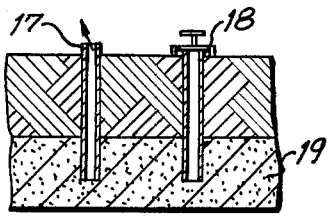

Once the permeability of the coal seam between bore holes 17 and 18 has reached a desired level, the bulk of the reagent may be recovered from the coal seam by the use of vacuum applied at the mouth of bore hole 17 or by sweeping air, inert gas, or steam through the coal seam, the air of other gas being introduced, preferably, at bore hole 18 (FIG. 2B).

During the treatment of the coal seam with the reagent, methane is released from the coal. This methane can readily be separated from the reagent during the recovery of the reagent. Moreover, the quantity of methane released is sufficiently great so that it can economically be sold. In fact, treatment with the permeability-enhancing reagent to remove methane may be utilized in combination with conventional mining techniques merely for the purpose of recovering the methane. In addition the danger of explosion resulting from mining in the presence of methane is reduced greatly.

Figure 2C:
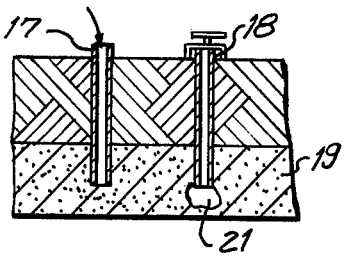

After recovery of as much of the reagent as is readily feasible, either by the use of vacuum or a gas stream, a heater is introduced into the coal seam at the bottom of bore hole 18, maintained in operation for a period sufficiently long to raise the coal in the immediate vicinity of bore hole 18 to the combustion point, and combustion is started by the introduction of air through bore hole 17 as shown in FIG. 2C. The region of combustion is indicated by the reference numeral 21. Further combustion then proceeds in a manner similar to that shown in FIGS. 1C through 1F.

Figure 3:
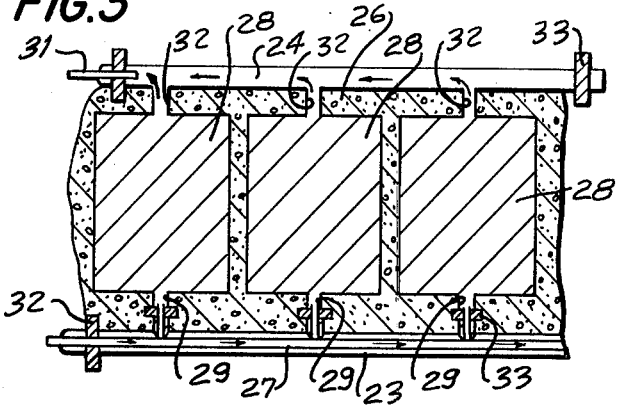
FIG. 3 is a plan view of a coal seam which has been fitted with conventional galleries, showing how such a seam can be operated in accordance with the present invention.

Due to the fact that the permeability-enhancing treatment of the present invention is surprisingly effective, bore holes to be operated in pairs, that is, in conjunction, can be as far apart as 200 ft or, even further. In general, the distance between bore holes to be operated in conjunction can be sunstantially greater than the present limit of about 100 ft.

Where coal seams are provided with galleries as shown in FIG. 3, the coal may be conveniently divided into panels by means of dams. As shown in FIG. 3, the coal seam has galleries 23 and 24 through which the coal seam can be entered for construction of dams 26 of brick or concrete. Gallery 23 is provided with a concentric pipe 27. The reagent to be used for enhancing the permeability of coal in panel 28 is introduced through inner concentric pipe 27 and branch pipes 29. After completion of the enhancement treatment, the reagent is removed through gallery 24 and outlet pipe 31 which leads to the surface. An electric heater (not shown) is introduced to raise the temperature in each panel to the combustion point after which an oxygen-containing gas is introduced through concentric pipe 27 and branch tubes 29 to generate combustible gas in panels 28, the combustible gas then being removed through branch tubes 32 and out to the surface through pipe 31. When the panels are completely burned out stoppings 33 are used to seal the galleries, and operation is started in new panels.

Figure 4:
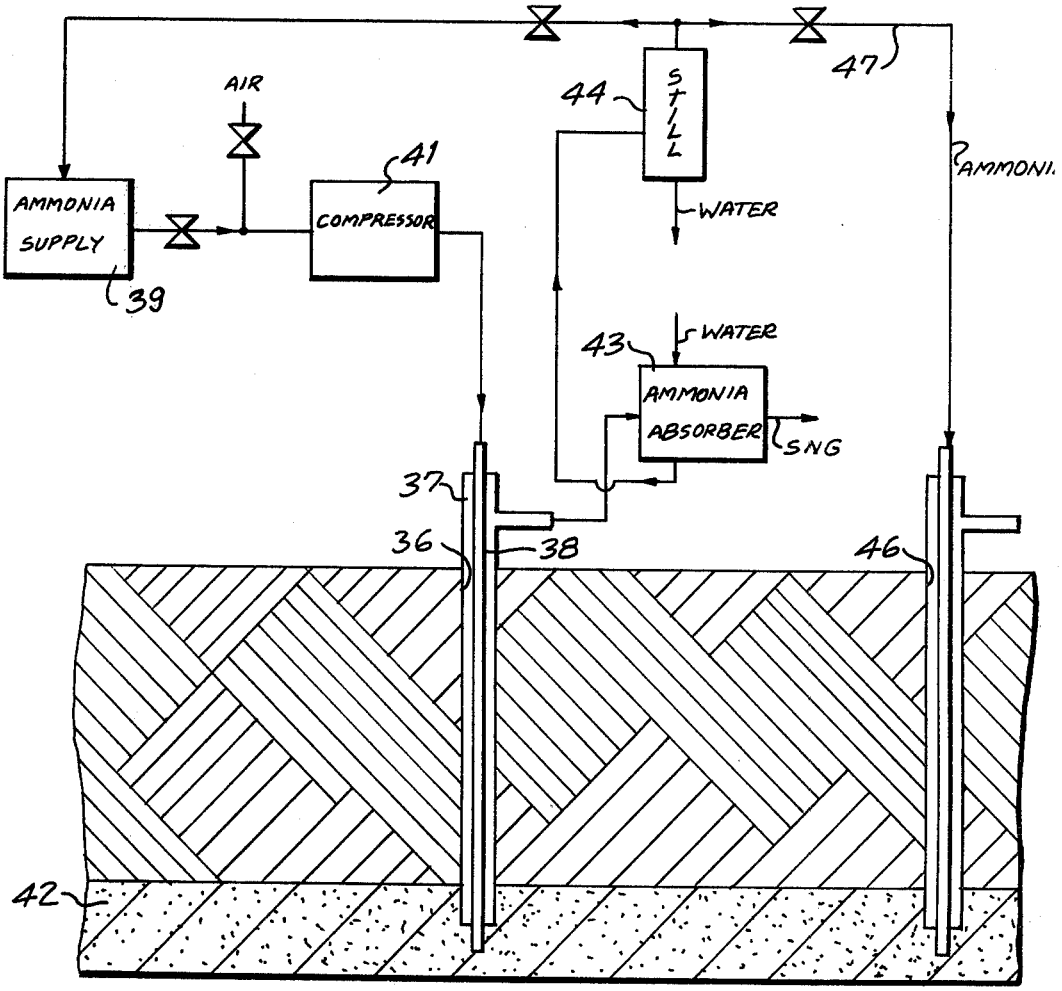
FIG. 4 shows schematically apparatus for carrying out the process of the present invention.

In the embodiments discussed up to this point at least two bore holes have been used for the pre-treatment and combustion of a panel of coal. However, the process can be effected through the use of a single bore hole containing two pipes, the pipes, preferably, being concentric. Such a bore hole is shown in FIG. 4, bore hole 36 having a pair of concentric pipes 37 and 38 therein. Reagent supply tank 39, indicated in FIG. 4 as containing ammonia, is introduced by compressor 41 through interior pipe 38 into coal seam 42 and kept in position for a period long enough to achieve the desired degree of enhancement of the permeability of the coal in said coal seam 42. Air can then be introduced by means of compressor 41 through interior pipe 38 to sweep the reagent out of coal seam 42 and out through exterior pipe 37 to ammonia absorber 43, which is supplied with water to recover the ammonia. The ammonium hydroxide thus produced is transferred to still 44 to recover the ammonia and return same to the ammonia supply tank 39. The water can be recycled to the absorber with such make-up water as is necessary. Leaving the absorber during this stage is the methane released from the coal by the treatment with reagent. As aforenoted, this methane can be vended.

Combustion is then started in the manner described, air of oxygen being supplied by compressor 41. Where air is supplied, the product is Synthetic Natural Gas of low Btu content. Where oxygen is supplied, the product is SNG of high Btu content.

The process is continued until the region of combustion approaches the vicinity of bore hole 46, said bore hole 46 also being fitted with concentric pipes and being separated from bore hole 36 by a distance which, preferably, is substantially in excess of 100 ft. During the combustion step carried out in connection with bore hole 36, treatment of the coal with a permeability-enhancing reagent and recovery of said reagent can be effected through bore hole 46. When the region of combustion is sufficiently close to bore hole 46, supply of oxygen-containing gas to bore hole 36 is stopped and supply to bore hole 46 is initiated. Most important, it is completely unnecessary to shut down the operation since the temperature of the coal proximate bore hole 46 will be high enough for combustion to take place. Consequently, combustion of a coal seam can be carried out on a continuous basis by drilling successive bore holes at appropriate spacings. Also, it should be noted that this process of utilizing successive bore holes is not limited to the arrangement of FIG. 4 which utilizes two pipes in each bore hole. Thus, as shown and explained in connection with FIGS. 2A through 2C, the first treatment with permeability-enhancing reagent and combustion can be carried out through the use of two bore holes 17 and 18 each having a single pipe therein. While combustion is proceeding, treatment of another section of the coal seam, preferably contiguous with that under treatment by use of bore holes 17 and 18 is initiated through a third bore hole (not shown). When the panel between bore holes 17 and 18 is approaching exhaustion, the oxygen-containing gas can then be fed through bore hole 18 and the products of combustion removed through the third bore hole. Using this technique, an entire coal seam can be combusted without interruption, regardless of the dimensions thereof. Also, continuity of operation can be effected through other means. For instance, when ammonia is used as the reagent, after separation in still 44, it may be directed through line 47 to successive bore holes rather than being recycled through the supply tank.

The quantity of reagent to be injected into a coal seam will vary with the tank of the coal, the porosity thereof and, possibly, other factors such as the water content. In general, the quantity injected is from about 3 to about 7 tons of reagent per 1,000 cubic feet of coal seam. However, this quantity may vary outside these limits, depending upon the factors already noted.

The fraction of reagent recovered subsequent to treatment of the coal seam will vary with the specific reagent, the quantity of water in the seam and the technique used for recovery, that is, whether vacuum or sweeping with air, as well as with the duration of the recovery step. Up to about 90% of the reagent can be recovered economically, though in favorable cases, even higher recovery rates can be achieved.

Although the coal seams shown in the various Figures are disposed horizontally, many coal seams are positioned at angles as far away from the horizontal as 45°, and in some cases, the coal seam orientation may be even steeper. Such orientations in no way interfere with the operation of the process disclosed herein.

The enhancement of permeability of coal is disclosed herein is also useful where the objective is dissolution of the coal rather than the production of a combustible gas. Accordingly, after treatment of coal by the process of the present invention and recovery of the reagent used for this step, a coal solvent such as propylamine may be introduced for taking the coal into solution. The process of dissolving coal is ordinarily extremely slow due to the low permeability of the coal. However, when pre-treated with a permeability-enhancing reagent as taught herein, the dissolution process is greatly accelerated.

In some cases, it may prove desirable to mine coal from a coal seam by conventional techniques and then to increase the permeability thereof in preparation either for gasification or dissolution. Coal in large blocks can be placed in a vessel, treated with permeability-enhancing reagent, the reagent recovered, and combustion or dissolution then carried out as desired. Where the water of the coal is below about 10%, it may be advantageous to inject steam into the vessel, during or after treatment of said coal with said reagent.

The mechanism by which the permeability-enhancing treatment of the present invention functions is not completely known, but it is believed that the mechanism includes several simultaneous or successive steps. These include fracture along bedding planes, mineral matter-coal boundaries and cleats and fault planes, formation of minute fissures along coal lithotype boundaries and along mineral matter boundaries. In addition, the treatment with reagent may dissolve minute quantities of compounds such as resins and waxes in the coal, such dissolution leading to an increase in the porosity and in the internal surface area of the coal. Further, the number of open pores in the coal may be increased so that the internal surface area which is made up of connected and unconnected pores may be increased. Another possibility is the swelling of the coal which results in some cases when the coal is treated with the reagent. This swelling of the coal could cause fracture and increase of the interior surface area of the pores. The increase in internal surface area causes the coal in the coal seam to behave like a packed bed reactor during combustion, such reactors being known to have high efficiency and combustion rates.

It will thus be seen that the objects set forth above, among those made apparent from the preceding description, are efficiently attained and, since certain changes may be made in carrying out the above process without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved process for the gasification of coal, comprising the steps of introducing a member of the group consisting of gaseous anhydrous ammonia, liquid anhydrous ammonia, aqueous ammonia and combinations thereof and methanol into a coal seam, allowing said member to remain in contact with the coal in said coal seam for a long-enough period to increase substantially the permeability thereof to flow of fluid therethrough, removing at least a portion of said member of said group, raising the temperature of at least a portion of the coal in said seam to combustion point and introducing an oxygen-containing gas into said seam under conditions such as to produce a combustible gas from said coal.

2. The improved process as defined in claim 1, wherein said member of said group is gaseous anhydrous ammonia.

3. The improved process as defined in claim 1, wherein said member of said group is liquid anhydrous ammonia.

4. The improved process as defined in claim 1, wherein said member of said group is aqueous ammonia.

5. The improved process as defined in claim 1, wherein said member of said group is methanol.

6. The improved process as defined in claim 1, further comprising the step of recovering at least a portion of said member of said group from said coal seam prior to introducing said oxygen-containing gas thereinto.

7. The improved process as defined in claim 6, further comprising the step of recovering at least a portion of any methane released from said coal seam during said introduction of said member of said group.

8. The improved process as defined in claim 6, further comprising the step of recovering at least a portion of any member of said group contained in said combustible gas.

9. The improved process as defined in claim 1, further comprising the step of forming an opening from the surface of the earth to said coal seam, providing within said opening first means for introduction into said coal seam of said member of said group and said oxygen-containing gas and second means for removal of said portion of said member of said group and said combustible gas.

10. The improved process as defined in claim 9, wherein at least a portion of said member of said group is removed from said coal seam by passing a member of the group consisting of air, inert gases and steam into said seam through said first means and out of said seam through said second means prior to raising the temperature of said coal.

11. The improved process as defined in claim 9, wherein at least a portion of said member of said group is removed from said coal seam by the step of reducing the pressure in said seam below atmospheric.

12. The improved process as defined in claim 1, wherein said member of said group is introduced into said coal seam at a partial pressure above atmospheric.

13. The improved process as defined in claim 1, wherein said member of said group is introduced into said coal seam in combination with a member of the group consisting of air, inert gases, and steam.

14. The improved process as defined in claim 1, further comprising the step of forming two openings from the surface of the earth to separate points in said coal seam, the step of introducing said member of said group being effected through at least one of said openings, the step of allowing said member of said group to remain in contact with said coal seam being continued until the permeability of said seam to said fluid is increased over a course extending from one of said separate points to the other, and to an extent such that fluid can flow sufficiently rapidly between said points to support combustion, raising the temperature of said coal seam to the combustion point at at least one of said separate points, passing oxygen-containing gas through one of said openings and along said course to the other of said points, and removing said combustible gas through the other of said openings.

15. The improved process as defined in claim 14, wherein said openings are spaced apart by a distance substantially greater than about 100 feet.

16. The improved process as defined in claim 14, further comprising the step of forming further openings from the surface of the earth to said coal seam, introducing a member of said group into said coal seam in such position as to form a successive fluid-permeable course from an opening to each successive opening, raising a region in said course to the combustion point, and using said successive opening for one of the steps of introducing an oxygen-containing gas and removing a combustible gas.

17. The improved process as defined in claim 16, wherein said successive openings are spaced apart by a distance substantially greater than about 100 feet.

18. The improved process as defined in claim 1, wherein said oxygen-containing gas is air.

19. The improved process as defined in claim 1, wherein said oxygen-containing gas is oxygen.

20. The improved process as defined in claim 1, further comprising the steps of removing said combustible gas from said coal seam for distribution of said combustible gas, and treating said combustible gas for removal therefrom of at least a portion of any sulfur-containing components.

21. The improved process as defined in claim 1, wherein the member of said group added is gaseous ammonia, and the quantity added in from about 3 to about 7 tons per 1000 $ft^3$ of coal seam, the fluid-permeability of which is to be introduced.

* * * * *